US005738981A

United States Patent [19]

Dickerson et al.

[11] Patent Number: 5,738,981

[45] Date of Patent: Apr. 14, 1998

[54] FILMS FOR REPRODUCING MEDICAL DIAGNOSTIC IMAGES AND PROCESSES FOR THEIR USE

[75] Inventors: Robert Edward Dickerson, Hamlin; Wray Earl Paul, Penfield, both of N.Y.

[73] Assignee: Eastman Kodak Company, Rochester, N.Y.

[21] Appl. No.: 688,980

[22] Filed: Jul. 31, 1996

[51] Int. Cl.[6] ..... G03L 1/815

[52] U.S. Cl. ..... 430/509; 430/567; 430/517; 430/966

[58] Field of Search ..... 430/509, 567, 430/966, 945, 517

[56] References Cited

U.S. PATENT DOCUMENTS

| | | | |
|---|---|---|---|
| 3,545,971 | 12/1970 | Barnes et al. | 96/61 |
| 3,859,527 | 1/1975 | Luckey | 250/327 |
| 4,414,304 | 11/1983 | Dickerson | 430/353 |
| 4,425,425 | 1/1984 | Abbott et al. | 430/502 |
| 4,425,426 | 1/1984 | Abbott et al. | 430/502 |
| 4,803,150 | 2/1989 | Dickerson et al. | 430/502 |
| 4,900,652 | 2/1990 | Dickerson et al. | 430/502 |
| 5,164,993 | 11/1992 | Capozzi et al. | 382/6 |

OTHER PUBLICATIONS

Research Disclosure, vol. 184, Item 18431, Section V.

*Primary Examiner*—Thorl Chea
*Attorney, Agent, or Firm*—Carl O. Thomas

[57] ABSTRACT

A silver halide film for reproducing digitally stored medical diagnostic images through exposure and processing, including development, fixing and drying, in 90 seconds or less is disclosed in which onto a film support transparent to exposing radiation are coated (1) a processing solution permeable front layer unit coated on the front major face of the support capable of absorbing up to 60 percent of the exposing radiation and containing less than 30 mg/dm$^2$ of hydrophilic colloid and less than 20 mg/dm$^2$ silver in the form of radiation-sensitive silver halide grains and (2) a processing solution permeable back layer unit coated on the back major face of the support containing less than 40 mg/dm$^2$ of hydrophilic colloid, silver in the form of radiation-sensitive silver halide grains accounting for from 40 to 60 percent of the total radiation-sensitive silver halide present in the film, and a dye capable of providing an optical density of at least 0.50 in the wavelength region of the exposing radiation intended to be recorded and an optical density of less than 0.1 in the visible spectrum at the conclusion of film processing. The film can be exposed by an exposure source such as a cathode ray tube, light emitting diode or laser. In one form, in processing the film one of the layer units having faster silver halide grains is oriented above the remaining layer unit while developer is circulated across the film from a jet located above the layer unit having the faster silver halide grains.

1 Claim, No Drawings

FILMS FOR REPRODUCING MEDICAL DIAGNOSTIC IMAGES AND PROCESSES FOR THEIR USE

FIELD OF THE INVENTION

The invention relates to films containing radiation-sensitive silver halide emulsions for reproducing medical diagnostic images.

DEFINITIONS

James *The Theory of the Photographic Process,* 4th Ed., Macmillan, New York, 1977, is hereinafter referred to as "James".

References to silver halide grains or emulsions containing two or more halides name the halides in order of ascending concentrations (see James p. 4).

The term "high chloride" refers to silver halide grains and emulsions that contain greater than 50 mole percent chloride, based on total silver.

The terms "front" and "back" are herein employed to indicate the sides of a film nearest and farthest, respectively, from a source of radiation when imagewise exposed.

The term "dual-coated" refers to a film that has silver halide emulsion layers coated on opposite sides of its support.

The term "half peak absorption bandwidth" of a dye is the spectral range in nm over which it exhibits a level of absorption equal to at least half of its peak absorption ($\lambda_{max}$).

The term "rapid access processor" is employed to indicate a radiographic film processor that is capable of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "cold" in referring to image tone is used to mean an image tone that has a CIELAB b* value measured at a density of 1.0 above minimum density that is −6.5 or more negative. Measurement technique is described by Billmeyer and Saltzman, Principles of Color Technology, 2nd Ed., Wiley, New York, 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P010 7DQ, England.

BACKGROUND

The use of radiation-sensitive silver halide emulsions for medical diagnostic imaging can be traced to Roentgen's discovery of X-radiation by the inadvertent exposure of a silver halide photographic element. In 1913 the Eastman Kodak Company introduced its first product specifically intended to be exposed to X-radiation.

The first X-ray film contained a single radiation-sensitive silver halide emulsion layer coated on a transparent film support. However, the imaging efficiency was not comparable to that obtained by light exposure, since silver halide has a relatively limited ability to absorb X-radiation, which has a much higher energy level than visible light. As a result, patient exposures to X-radiation were quite high by modern standards.

Two improvements were introduced within 5 years of the initial X-ray film offering that are still used in forming most medical diagnostic images using X-radiation. First, the silver halide was coated on both the front and back sides of the film support (i.e., dual-coated) to double its absorption capacity, and, second, intensifying screens were mounted adjacent each emulsion layer. Each intensifying screen contains a phosphor that absorbs X-radiation and emits light. A dual-coated film-screen combination has about 20 times the imaging efficiency of the film alone.

Most medical diagnostic images are produced by dual-coated (e.g., Duplitized™) film employed in combination with a pair of intensifying screens. A continuing problem with this arrangement has been that each intensifying screen emits light that is not only recorded by the silver halide emulsion on the adjacent side of the film support, but also by the silver halide emulsion on the opposite of the film support. This results in an reduction in image sharpness and is referred to as crossover.

The state-of-the-art of X-ray film construction through the 1970's is illustrated by *Research Disclosure,* Vol. 184, item 18431, August 1979, Section V. Cross-Over Exposure Control specifically demonstrates techniques that have been proposed in the art to reduce transmission of light through the film support during exposure and thereby reduce crossover.

As radiologists began to generate large volumes of medical diagnostic images, the need arose for more rapid processing. The emergence of rapid access processing is illustrated by Barnes et al U.S. Pat. No. 3,545,971. Successful rapid access processing requires limiting the drying load—that is, the water ingested by the hydrophilic colloid layers, principally the silver halide emulsion layers, that must be evaporated to produce a dry image bearing element. One possible approach is to foreharden the film fully, thereby reducing swelling (water ingestion) during processing. Because silver image covering power (maximum density divided by the silver coating coverage) of silver halide medical diagnostic films was markedly reduced by forehardening of the films, it was the accepted practice not to foreharden the films fully, but to complete hardening of diagnostic films during rapid access processing by incorporating a pre-hardener, typically glutaraldehyde, in the developer.

Since silver halide emulsions require hydrophilic colloid for their preparation and full forehardening of non-tabular grain emulsion layers leads to marked reduction in silver covering power, reduction of the drying load placed on the rapid access processors has largely focused on limiting the hydrophilic colloid content of the medical diagnostic elements. However, when the hydrophilic colloid content of the emulsion layer falls too low, the problem of wet pressure sensitivity is encountered. Wet pressure sensitivity is the appearance of graininess produced by applying pressure to the wet emulsion during development. In rapid access processing the film passes over guide rolls, which are capable of applying sufficient pressure to the wet emulsion during development to reveal any wet pressure sensitivity, particularly if any of the guide rolls are in less than optimum adjustment.

Dickerson U.S. Pat. No. 4,414,304 (hereinafter referred to as Dickerson I) demonstrates full forehardening with low losses in covering power to be achievable with thin tabular grain emulsions.

Abbott et al U.S. Pat. Nos. 4,425,425 and 4,425,426 (hereinafter collectively referred to as Abbott et al) demonstrate that spectrally sensitized tabular grain emulsions are capable of reducing crossover to less than 20 percent.

Subsequently, Dickerson et al U.S. Pat. Nos. 4,803,150 and 4,900,652 (hereinafter referred to as Dickerson et al I and II) demonstrated an ideal arrangement for essentially eliminating crossover by employing spectrally sensitized tabular grain emulsions in combination with front and back coatings that contain a particulate processing solution decolorizable dye interposed between the front and back emulsion layers and the support.

Dickerson et al II further addresses the advantage of accelerated rapid access processing attributable to the combination of a dual-coated format, tabular grain emulsions and controlled hydrophilic colloid coating coverages.

Luckey U.S. Pat. No. 3,859,527 proposed substituting for the prompt emitting phosphor in an intensifying screen a stimulable storage phosphor. This permits a retrievable medical diagnostic image to be captured and stored within the phosphor coating. The image is retrieved by subsequently stimulating emission from the phosphor layer and transferring the image information to storage within a digital computer for subsequent recreation of the image for viewing.

In recent years a number of alternative approaches to medical diagnostic imaging, particularly image acquisition, have become prominent. Medical diagnostic devices in addition to storage phosphor screens, including CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light emitting diode (LED) or a light bar (a linear series of independently addressable LED's). The image is recreated as a series of laterally offset pixels. Another approach is to use the image of a CRT monitor to expose a silver halide film.

Initially the radiation-sensitive silver halide films were essentially the same films used for radiographic imaging, except the silver halide emulsion is coated on only one side of the support, since exposing light is received entirely from the front side. Another adjustment was that finer silver halide grains were substituted to minimize noise (granularity). The advantages of the types of films conventionally used for medical diagnostic imaging to provide a hard copy of the digitally stored image are that medical imaging centers are already equipped to process silver halide medical diagnostic films and are familiar with their image characteristics.

A typical film, Kodak Ektascan HN™, for creating a hard copy of a digitally stored medical diagnostic image includes an emulsion layer coated on a clear or blue tinted polyester film support. The emulsion layer contains a red-sensitized silver iodobromide (2.5M % I, based on Ag) cubic grain (0.33 μm ECD) emulsion coated at a silver coverage of 30 mg/dm$^2$. A conventional gelatin overcoat is coated over the emulsion layer. The total hydrophilic colloid coating coverage on the front side of the support is 44.1 mg/dm$^2$. On the back side of the support a pelloid layer containing a red-absorbing antihalation dye is coated. A gelatin interlayer, used as a hardener incorporation site, overlies the pelloid layer, and a gelatin overcoat containing an antistat overlies the interlayer. Developed silver is relied upon to provide the infrared density required to activate processor sensors. No dye is introduced for the purpose of increasing infrared absorption.

Typically silver halide diagnostic films, including the film described above, is processed in a rapid access processor in 90 seconds or less. For example, the Kodak X-OMAT M6A-N™ rapid access processor employs the following processing cycle:

| | |
|---|---|
| Development | 24 seconds at 35° C. |
| Fixing | 20 seconds at 35° C. |
| Wasing | 20 seconds at 35° C. |
| Drying | 20 seconds at 65° C. |

with up to 6 seconds being taken up in film transport between processing steps.

A typical developer (hereinafter referred to as Developer A) exhibits the following composition:

| | |
|---|---|
| Hydroquinone | 30 g |
| Phenidone ™ | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |
| Glutaraldehyde | 4.9 g |
| Water to 1 liter/pH 10.0 | |

A typical fixer exhibits the following composition:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9–4.5 | |

Dickerson et al U.S. Pat. No. 5,637,447 discloses a radiation-sensitive film for reproducing digitally stored medical diagnostic images through a series of laterally offset exposures by a controlled radiation source followed by processing in 90 seconds or less including development, fixing and drying is disclosed. The film exhibits an average contrast in the range of from 1.5 to 2.0, measured over a density above fog of from 0.25 to 2.0. An emulsion is provided on the front side of the support. The emulsion contains silver bromochloride grains (a) containing at least 10 mole percent bromide, based on silver, (b) having a mean equivalent circular diameter of less than 0.40 μm, (c) exhibiting an average aspect ratio of less than 1.3, and (d) coated at a silver coverage of less than 40 mg/dm$^2$. Adsorbed to the surfaces of the silver bromochloride grains is at least one spectral sensitizing dye having an absorption half peak bandwidth in the spectral region of exposure by the controlled exposure source. The film also contains an infrared opacifying dye capable of reducing specular transmission through the film before, during and after processing to less than 50 percent, measured at a wavelength within the spectral region of from 850 to 1100 nm.

RELATED APPLICATION

Dickerson U.S. Ser. No. 08/090,138, concurrently filed and commonly assigned, titled A MEDICAL DIAGNOSTIC FILM FOR SOFT TISSUE IMAGING, discloses a radiographic film for recording medical diagnostic images of soft tissue through exposure by a single intensifying screen located between an image bearing source of X-radiation and the film and processing, including development, fixing and drying, in 90 seconds. The film is capable of providing, when imagewise exposed by the intensifying screen and processed, an average contrast in the range of from 2.5 to 3.5, measured over a density above fog of from 0.25 to 2.0. The film is comprised of a support that is transparent to radiation emitted by the intensifying screen, a processing solution permeable front layer unit coated on the front major face of the support capable of absorbing up to 60 percent of the exposing radiation and containing less than 30 mg/dm$^2$ of hydrophilic colloid and less than 30 mg/dm$^2$ silver in the form of radiation-sensitive silver halide grains, and a processing solution permeable back layer unit coated on the back major face of the support containing less than 40 mg/dm$^2$ of hydrophilic colloid, silver in the form of radiation-sensitive silver halide grains accounting for from 40 to 60 percent of the total radiation-sensitive silver halide present in the film, and a dye capable of providing an optical density of at least 0.40 in the wavelength region of the exposing radiation intended to be recorded and an optical density of less than 0.1 in the visible spectrum at the conclusion of film processing.

Problem to be Solved

Dual-coated silver halide medical diagnostic elements are ideally suited for rapid access processing, since the silver and therefore the required hydrophilic colloid is equally distributed between the front and back sides of the support. This lowers the required levels of hydrophilic colloid per side, which limits the rate of processing. Fortuitously, dual-coated silver halide medical diagnostic elements employ tabular grains. This allows full-forehardening without objectionable loss of covering power. Full-forehardening further limits water pick-up and facilitates acceleration of the rate of processing. The tabular grains when spectrally sensitized are capable of lowering crossover to less than 20 percent and when combined with a processing solution decolorizable dye, interposed between the each of the front and back emulsion layers and the support, are capable of essentially eliminating crossover. A further fortuitous advantage of these dual-coated elements is that the coatings on the front and back sides of the support are balanced, thereby obviating the problem of curl that occurs with film coated on only one side.

Films intended to be used with rapid access processors for providing a hard copy of a digitally stored medical diagnostic image suffer a variety of problems. Since imagewise exposure (e.g., by a laser, LED or CRT) comes from only one side of the support, all of the silver halide and the necessary accompanying hydrophilic colloid are coated on the front side of the support. This requires higher coating coverages of silver halide and hydrophilic colloid than dual-coated films and therefore limits the maximum attainable processing rates to lower levels than are attainable with dual-coated films. It also requires the inclusion of an anti-curl (a.k.a. pelloid) layer on the back side of the support.

SUMMARY OF THE INVENTION

The present invention has as its purpose to provide a film capable of providing a hard copy of a digitally stored medical diagnostic image of acceptable quality through processing at the same high rates currently employed for providing medical diagnostic images in dual-coated film. The present invention also eliminates any need for an anti-curl or pelloid layer.

This has been achieved by the construction of a dual-coated film structure that is capable of producing images of diagnostically acceptable quality when imagewise exposed only from the front side. It was entirely unexpected that a dual-coated film structure could be constructed to produce images of acceptable quality images by front side only imagewise exposure.

In one aspect this invention is directed to a radiation-sensitive silver halide film for reproducing digitally stored medical diagnostic images through exposure and processing, including development, fixing and drying, in 90 seconds or less comprised of a film support transparent to exposing radiation intended to be recorded having opposed front and back major faces, a processing solution permeable front layer unit coated on the front major face of the support capable of absorbing up to 60 percent of the exposing radiation and containing less than 30 mg/dm$^2$ of hydrophilic colloid and less than 30 mg/dm$^2$ silver in the form of radiation-sensitive silver halide grains, and a processing solution permeable back layer unit coated on the back major face of the support containing less than 40 mg/dm$^2$ of hydrophilic colloid, silver in the form of radiation-sensitive silver halide grains accounting for from 40 to 60 percent of the total radiation-sensitive silver halide present in the film, and a dye capable of providing an optical density of at least 0.40 in the wavelength region of the exposing radiation intended to be recorded and an optical density of less than 0.1 in the visible spectrum at the conclusion of film processing.

In an another aspect the invention is directed to a process of imagewise exposing a radiation-sensitive silver halide film for reproducing digitally stored medical diagnostic images according to this invention.

In an additional aspect the invention is directed to a process of developing, fixing and drying a radiation-sensitive silver halide film for reproducing digitally stored medical diagnostic images wherein one of the layer units having faster silver halide grains is oriented above the remaining layer unit while developer is circulated across the film from a jet located above the layer unit having the faster silver halide grains.

DESCRIPTION OF PREFERRED EMBODIMENTS

A film satisfying the requirements of the invention contains the following elements:

| |
|---|
| Front Layer Unit (FLU) |
| Transparent Film Support (S) |
| Back Layer Unit (BLU) |

(I)

The transparent film support S is transparent to radiation employed for imagewise exposure of the film. Additionally the film support is transparent in the visible region of the spectrum to permit simultaneous viewing of images in the front and back layer units after imagewise exposure and processing.

Although it is possible for the transparent film support to consist of a flexible transparent film, the usual construction is as follows:

| Surface Modifying Layer Unit (SMLU) |
|---|
| Transparent Film (TF) |
| Surface Modifying Layer Unit (SMLU) |

(S-I)

Since the transparent film TF is typically hydrophobic, it is conventional practice to provide surface modifying layer units SMLU to promote adhesion of the hydrophilic front and back layer units. Each surface modifying layer unit typically consists of a subbing layer overcoated with a thin, hardened hydrophilic colloid layer. While any conventional transparent photographic film support can be employed, it is preferred to employ the same types of transparent film supports employed in conventional dual-coated medical diagnostic films, since this maximizes compatibility with the rapid access processors in which the films of the invention are intended to be processed and provides a medical diagnostic film look and feel to the processed film. Medical diagnostic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processed films, whereas photographic films rarely, if ever, employ blue tinted supports. Medical diagnostic film supports, including the incorporated blue dyes that contribute to cold image tones, are described in *Research Disclosure,* Item 18431, cited above, Section XII. Film Supports. *Research Disclosure,* Vol. 365, September 1994, Item 36544, Section XV. Supports, illustrates in paragraph (2) suitable surface modifying layer units, particularly the subbing layer components, to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene) are specifically preferred polyester film supports.

In the simplest contemplated form of the invention the front layer unit FLU consists of a single silver halide emulsion layer. To facilitate rapid access processing it is contemplated to limit coating coverages of silver halide grains contained in the emulsion layer to less than 30 $mg/dm^2$ silver, thereby allowing hydrophilic colloid necessary to protect the grains from wet pressure sensitivity to be limited to less than 30 $mg/dm^2$.

Further, the emulsion layer is selected so that it absorbs no more than 60 percent, preferably no more than 50 percent, of radiation employed for imagewise exposure. Limiting absorption of exposing radiation by the front layer unit is essential to permit efficient utilization of the back layer unit.

Tabular grains in the limited silver coating coverage ranges of this invention are not preferred, since they produce higher granularity than is desired. While tabular grains provide a favorable balance between speed and granularity where exposing radiation is limited (and hence speed is important), for the applications the elements of the invention are intended to serve, providing a hard copy of a digitally stored image information, the intensity and duration of exposure is controlled and hence there is no need to incur diminution of image quality (increase in granularity) for the sake of increasing speed.

In a preferred form of the invention the emulsion forming the front layer unit is chosen to offer a particularly advantageous combination of properties:

(1) Rapid processing, allowing compatibility with rapid access processors (including those having dry-to-dry processing in less than 40 seconds) used for conventional dual-coated medical diagnostic films;

(2) High covering power, allowing low silver coating coverages; and (3) Enhanced image tone properties—that is, negative b* values when coated in films lacking blue dye incorporation and cold image tones with lower minimum densities when coated in films containing blue dye.

These properties are in part achieved by choosing emulsions containing silver bromochloride grains. Since the emulsions are intended to be exposed by a controlled radiation source, a slight increase in imaging speed that might be gained by iodide incorporation offers little or no practical benefit and is, in fact, a significant disadvantage when the reduction of development and fixing rates produced by iodide incorporation are taken into consideration. Iodide also contributes to warmer image tone. Thus, the grains as contemplated for use are substantially free of iodide.

The grains contain at least 50 mole percent chloride. It is known that silver chloride exhibits a higher level of solubility than other photographic halides and hence the fastest development and fixing rates. While this might suggest the use of pure silver chloride emulsions in the invention, this silver halide selection is not contemplated, since pure silver chloride emulsions have been observed to exhibit much lower covering power than the silver bromide and iodobromide emulsions conventionally employed in medical diagnostic imaging films.

It has been discovered that, if at least about 10 mole percent bromide, based on total silver, is incorporated into the emulsion grains, covering power is increased to approximately the higher covering power levels of silver bromide, most commonly used in medical diagnostic imaging films. The grains preferably contain from about 20 to 40 mole percent bromide, based on total silver contained in the grains.

Bromide incorporated in the grains to increase covering power also shifts image tones; however, the emulsions retain negative b* values.

In addition to selecting the halide composition of the grains, the size of the grains is limited to increase the rate at which processing can occur. Specifically, it is contemplated to limit the average ECD of the grains to less than 0.40 μm. Preferably the emulsions are fine grain emulsions having mean grain ECD's in the range of from about 0.1 to 0.4 μm. For such fine grain emulsions nontabular grain populations are preferred. The average aspect ratio of a cubic grain emulsion is about 1.1. In the emulsions of the invention average aspect ratios of less than 1.3 are contemplated. The nontabular grains can take any convenient conventional shape consistent with the stated average aspect ratio. The grains can take regular shapes, such as cubic, octahedral or cubo-octahedral (i.e., tetradecahedral) grains, or the grains can other shapes attributable to ripening, twinning, screw dislocations, etc. Preferred grains are those bounded primarily by {100} crystal faces, since {100} grain faces are exceptionally stable.

The fine grain emulsions of the invention offer a relatively high ratio of surface area to grain volume and hence are particularly suited for rapid access processing. A common alternative approach for achieving high surface area to volume grain ratios is to employ a thin or high average aspect ratio tabular grain emulsion. A further advantage of the preferred fine grain emulsions over tabular grain emulsions and other larger grain size emulsions is that lower grain size dispersities are more readily realized in fine grain emulsions. Specifically, in the preferred emulsions of the invention the COV of the emulsions is less than 20 percent and, optimally, less than 10 percent.

Lower grain dispersities allow more efficient silver utilization in that a higher percentage of the total grain population can achieve near optimum sensitization. This in turn facilitates achieving optimum contrast ranges for digitally stored image reproduction. Blending of emulsions of different mean grain sizes can be used to fine tune contrast levels. It is specifically contemplated that the elements of the invention exhibit an average contrast in the range of from 1.5 to 2.0. Both the blending of emulsions and the coating of emulsions in separate superimposed layers are well known, as illustrated by *Research Disclosure,* Item 36544, I. Emulsion grains and their preparation, E. Blends, layers and performance categories, paragraphs (1), (2), (6) and (7).

The high covering power of the silver bromochloride grains allows coating coverages in the front layer unit to be maintained at less than 30 (preferably less than 20) mg/dm$^2$, based on silver. Coating coverages for highly monodisperse emulsions as low as about 10 (preferably about 15) mg/dm$^2$ are contemplated.

The silver bromochloride emulsions can be selected from among conventional emulsions. A general description of silver halide emulsions can be found in *Research Disclosure,* Item 36544, I. Emulsion grains and their preparation. The most highly monodisperse (lowest COV) emulsions are those prepared by a batch double-jet precipitation process. It is noted that high (>50 mole percent) chloride emulsions containing minor amounts of bromide otherwise satisfying the grain requirements of this invention are commonly used for preparing photographic reflection prints. Specific examples of these emulsions are provided Hasebe et al U.S. Pat. No. 4,865,962, Suzumoto et al U.S. Pat. No. 5,252,454, and Oshima et al U.S. Pat. No. 5,252,456, the disclosures of which are here incorporated by reference. The silver bromochloride grains of conventional high chloride emulsions intended for graphic arts applications are also well suited for use in the present invention. Although reflection print and graphic arts emulsions overlap the bromide concentration ranges of this invention, less than optimum bromide levels for this invention are preferred for those applications; however, only routine adjustments during precipitation are needed to realize the preferred silver bromochloride compositions of this invention. Generally any convenient distribution of bromide and chloride ions within the grains can be employed in the practice of the invention. It is generally preferred, based on convenience of preparation, to distribute bromide uniformly within the grains. Alternatively, silver bromide can be epitaxially deposited onto host grains containing lower levels of silver bromide (e.g., silver chloride host grains). The latter has the advantage of allowing the silver bromide epitaxy to act as a sensitizer.

In the course of grain precipitation one or more dopants (grain occlusions other than silver and halide) can be introduced to modify grain properties. For example, any of the various conventional dopants disclosed in *Research Disclosure,* Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference. Dopants for increasing imaging speed by providing shallow electron trapping sites (i.e. SET dopants) are the specific subject matter of *Research Disclosure,* Vol. 367, November 1994, item 36736.

Since the controlled radiation sources used to reproduce digitally stored images frequently employ short ($<10^{-1}$ second) exposure times and laser exposures in fractional microseconds are common, it is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, when the Ir dopant is in the form of a hexacoordination complex capable of additionally acting as a SET dopant, concentrations of up to about $5\times10^{-4}$ mole per silver, are contemplated. Specific illustrations of useful Ir dopants contemplated for reciprocity failure reduction are provided by B. H. Carroll, "Iridium Sensitization: A Literature Review", *Photographic Science and Engineering,* Vol. 24, No. 6 November/December 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the silver bromochloride emulsions can be increased by doping the grains with a hexacoordination complex containing a nitrosyl (NO) or thionitrosyl (NS) ligand. Preferred coordination complexes of this type are disclosed by McDugle et al U.S. Pat. No. 4,933,272, the disclosure of which is here incorporated by reference.

The contrast increasing dopants (hereinafter also referred to as NO or NS dopants) can be incorporated in the grain structure at any convenient location. However, if the NO or NS dopant is present at the surface of the grain, it can reduce the sensitivity of the grains. It is therefore preferred that the NO or NS dopants be located in the grain so that they are separated from the grain surface by at least 1 percent (most preferably at least 3 percent) of the total silver precipitated in forming the silver iodochloride grains. Preferred contrast enhancing concentrations of the NO or NS dopants range from $1\times10^{-11}$ to $4\times10^{-8}$ mole per silver mole, with specifically preferred concentrations being in the range from $10^{-10}$ to $10^{-8}$ mole per silver mole.

Combinations of Ir dopants and NO or NS dopants are specifically contemplated. Where the Ir dopant is not itself a SET dopant, it is specifically contemplated to employ non-SET Ir dopants in combination with SET dopants.

Where a combination of SET, non-SET Ir and NO or NS dopants are employed, it is preferred to introduce the NO or NS dopant first during precipitation, followed by the SET dopant, followed by the non-SET Ir dopant.

After precipitation and before chemical sensitization the emulsions can be washed by any convenient conventional technique. Conventional washing techniques are disclosed by *Research Disclosure,* Item 36544, cited above, Section III. Emulsion washing.

The emulsions can be chemically sensitized by any convenient conventional technique. Such techniques are illustrated by *Research Disclosure,* Item 36544, IV. Chemical sensitization. Sulfur and gold sensitizations are specifically contemplated.

Since silver bromochloride emulsions possess little native sensitivity beyond the ultraviolet region of the spectrum and controlled radiation sources used for exposure, such as lasers and LED's, are most readily constructed to provide exposures in the longer wavelength portions of the visible spectrum (e.g., longer than 550 nm) as well as the near infrared, it is specifically contemplated that one or more spectral sensitizing dyes will be absorbed to the surfaces of the silver chlorobromide grains. Ideally the maximum absorption of the spectral sensitizing dye is matched (e.g., within ±10 nm) to the exposure wavelength of the controlled exposure source. In practice any spectral sensitizing dye can be employed which, as coated, exhibits a half peak absorption bandwidth that overlaps the spectral region of exposure by the controlled exposure source.

A wide variety of conventional spectral sensitizing dyes are known having absorption maxima extending throughout the visible and near infrared regions of the spectrum. Specific illustrations of conventional spectral sensitizing dyes are provided by *Research Disclosure,* Item 18431, Section X. Spectral Sensitization, and Item 36544, Section V. Spectral sensitization and desensitization, A. Sensitizing dyes.

Since solid-state controlled exposure sources tend to be more efficient at longer wavelengths of emission, it might seem most advantageous to sensitize the silver bromochloride grains to the near infrared region of the spectrum. Instead, the best matches of photographic and controlled exposure sources is found in the red region of the spectrum. In the wavelength range of from about 633 to 690 nm there are a variety of popular controlled exposure sources in widespread use, including helium-neon lasers and light emitting diodes. It is generally realized that as the peak absorption of spectral sensitizing dyes is shifted toward progressively longer wavelengths the propensity for dye-desensitization is increased. Dye-desensitization is inferred from the speed of an emulsion when sensitized to a particular wavelength is observed to be less than would be expected based on native sensitivity or sensitization with another dye with a similar or shorter maximum absorption wavelength. An abundance of spectral sensitizing dyes with low dye-desensitization characteristics with peak absorptions in the red region of the spectrum and controlled exposure sources with emissions in the red region of the spectrum renders this a preferred combination for most imaging applications. Of course, as better controlled exposure sources are developed emitting at shorter visible wavelengths are developed, the choice of preferred spectral sensitizing dyes will similarly shift.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

The front layer unit need not be limited to a single layer. As noted above, the coating of separate silver halide grain populations in successive layers rather than blending is well known in the art. In addition, it is common practice to provide a surface overcoat (SOC) layer and, in many instances, the combination of an SOC layer and an interlayer (IL). These layers can be accommodated in the front layer unit so long as the overall coating coverage of the front layer unit of 30 mg/dm$^2$ of hydrophilic colloid is not exceeded. The contemplated sequence of layers is as follows:

| |
|---|
| Surface Overcoat (SOC) |
| Interlayer (IL) |
| Emulsion Layer (EL) |

(ELU-1)

where the emulsion layer EL is coated nearest the support.

The surface overcoat SOC is typically provided for physical protection of the emulsion layer. The surface overcoat contains a conventional hydrophilic colloid as a vehicle and can contain various addenda to modify the physical properties of the overcoats. Such addenda are illustrated by *Research Disclosure,* Item 36544, IX. Coating physical property modifying addenda, A. Coating aids, B. Plasticizers and lubricants, C. Antistats, and D. Matting agents. The interlayer IL, when present, is a thin hydrophilic colloid layer that provide a separation between the emulsion and the surface overcoat addenda. It is a quite common alternative to locate surface overcoat addenda, particularly matte particles, in the interlayer. The use of silver halide grains as matte particles to reduce gloss as taught by Childers et al U.S. Pat. No. 5,041,364 and as illustrated in the Examples below, is specifically contemplated.

The silver halide emulsion and other layers forming the processing solution permeable front layer unit contain conventional hydrophilic colloid vehicles (peptizers and binders), typically gelatin or a gelatin derivative. Conventional vehicles and related layer features are disclosed in *Research Disclosure,* Item 36544, II. Vehicles, vehicle extenders, vehicle-like addenda and vehicle related addenda. The emulsions themselves can contain peptizers of the type set out in II. above, paragraph A. Gelatin and hydrophilic colloid peptizers. The hydrophilic colloid peptizers are also useful as binders and hence are commonly present in much higher concentrations than required to perform the peptizing function alone. The vehicle extends also to materials that are not themselves useful as peptizers. Such materials are described in II. above, C. Other vehicle components.

The elements of the invention are preferably fully forehardened to facilitate accelerated rapid access processing. To increase covering power and hence allow reduction of both the levels of silver and hydrophilic colloid required, it is possible to partially foreharden and supplement hardening with a prehardener, such as glutaraldehyde, incorporated in the developer solution contained in the rapid access processor. Conventional forehardeners in II. above, B. Hardeners.

The processing solution permeable back layer unit (BLU) shares with the processing solution permeable front layer unit FLU responsibility for providing a viewable image. From 40 to 60 percent and, ideally, 50 percent of overall image density and hence corresponding percentages of the total radiation-sensitive silver halide present in the film is provided by BLU. The most efficient arrangement in terms of maximizing the rate at which the film can be processed is for the same amounts of silver to be coated in FLU and BLU.

BLU differs in its required function from FLU in that there is no requirement that it transmits any portion of the exposing radiation that it receives. It is, in fact, necessary that BLU absorb a larger percentage of the exposing radiation it receives than FLU, otherwise an image of unacceptably degraded sharpness results. BLU exhibits an optical density to exposing radiation of at least 0.50 (corresponding to about 70 percent absorption). Preferably the optical density of BLU is at least 1.0. Since the exposing radiation received by BLU that is not absorbed by it serves no useful purpose and sharpness is increased as the percentage of exposing radiation absorbed by BLU is increased, there is no theoretical maximum optical density. There is, as a practical matter, no significant further improvement in sharpness to be realized by increasing optical density above 3.0 and, for the majority of applications, the optical density of BLU is ideally in the range of from 1.0 to 2.0.

Although coating a higher percent of total silver in BLU than in FLU can contribute to increasing the optical density of BLU, the balance of silver required for rapid access processing precludes satisfying the optical density of BLU by simply increasing the silver in BLU.

In the wavelength ranges at which exposure of the film of the invention would ordinarily be exposed absorption of exposing radiation is almost, if not entirely, attributable to the spectral sensitizing dye adsorbed to the surface of the latent image forming silver halide grains. Increasing the proportion of this dye in relation to silver above its optimum levels for spectral sensitization to increase optical density is precluded, since this results in desensitization of the silver halide emulsion.

What then is required in BLU to increase its optical density to the levels indicated above is a dye capable of absorbing radiation of the wavelengths employed for imagewise exposure that also exhibits little or no desensitization of the silver halide emulsion. In addition the dye must exhibit an optical density of less than 0.1 in the visible spectrum at the conclusion of film processing.

Fortunately, a variety of dyes satisfying these criteria are known in the art. Where imagewise exposure occurs outside the visible spectrum, dyes can be selected that absorb efficiently in the wavelength ranges of imagewise exposure, but exhibit optical densities of less than 0.1 in the visible spectrum. For example, a conventional infrared absorbing dye having a half peak bandwidth chosen to match the emission wavelength of an infrared laser while exhibiting acceptably low levels of absorption in the visible spectrum. When imagewise exposure occurs within the visible spectrum, such as within the 633 to 690 nm region preferred for laser and LED exposures, noted above, the optical density of the dye must be reduced prior to the completion of processing. Dyes having these characteristics are disclosed in *Research Disclosure,* Item 36544, cited above, VIII. Absorbing and scattering materials, Section B. Absorbing materials, here incorporated by reference. Typically the dyes that absorb in the visible spectrum are processing solution decolorized. Usually one or more of the processing solutions alters the chromophore of the dye to eliminate optical density that is unwanted in the processed film. To eliminate or at least minimize emulsion desensitization the dyes are preferably coated as particulate dispersions, as disclosed particularly in Section B, paragraph (4).

In a form that simplifies manufacture the film can be coated so that BLU is identical to FLU, except that it additionally contains in an overcoat, e.g., SOC or IL, a dye as described above to increase optical density during imagewise exposure. If the dye is coated as an extra layer, some additional hydrophilic colloid is necessary to accomplish this and the hydrophilic colloid of BLU can exceed that of FLU, but it is contemplated that the hydrophilic colloid coverage of BLU will remain in all instances less than 40 $mg/dm^2$. Preferably the hydrophilic colloid coverage of BLU remains within the coating coverage ranges describe above for FLU.

It is additionally recognized that the dye incorporated to increase optical density can be placed directly within the emulsion layer or layers forming BLU, although this is not preferred, since the dye is then intercepting some of the exposing radiation that would otherwise be absorbed by the silver halide grains. On the other hand, if the optical density increasing dye is incorporated in the silver halide emulsion, this eliminates any necessity of adding hydrophilic colloid to BLU for the sole purpose of coating a dye containing layer. A specifically contemplated compromise is to split the emulsion contained in BLU into two layers, with the optical density increasing dye being confined to the layer farthest from the support. The one location of the optical density increasing dye that leads to unacceptable performance and is specifically excluded from the practice of the invention is placement of the dye in a layer interposed between the transparent film support and the emulsion layer or layers forming BLU.

Although BLU as described above can be identical to FLU, except for inclusion of the optical density increasing dye, in practice it is recognized that that these layer units can be independently varied in construction within the general ranges described above. While identical front and back emulsion coatings maximize manufacturing convenience, there are number of factors to indicate that optimization of performance dictates different selections of FLU and BLU components. Most notably, unlike a conventional dual-coated medical diagnostic film exposed by front and back intensifying screens, BLU receives only the fraction of exposing radiation that has not been absorbed by FLU. Thus, if identical emulsions are employed in FLU and BLU, the latter must necessarily make a smaller contribution to the overall image density. This can be offset by increasing the silver coverage of BLU above that of FLU. If the sensitivity of the silver halide grains in BLU is increased in relation to those of FLU, overall contrast is increased. If the sensitivity of the silver halide in FLU are increased in relation to those of BLU, exposure latitude can be increased. For most applications using controlled exposure sources, the former advantage, increased overall contrast, is advantageous while the latter advantage, increased exposure latitude, is more likely to be limited in the applications it can usefully serve.

In addition, it should be noted that, unlike, FLU, tabular grain emulsions, although not preferred, can be selected for inclusion in BLU. Optimally spectrally sensitized tabular grain emulsions are capable of absorbing a higher percentage of exposing radiation than nontabular grain emulsions of comparable speed. Thus, using a tabular grain emulsion in BLU can be undertaken to increase capture of exposing radiation in this layer unit.

In addition to the specific features of the elements of the invention described above, it is, of course, recognized that the elements of the invention can be modified to contain any one or combination of compatible conventional features not essential to the practice of the invention. Such features can be selected from those disclosed in *Research Disclosure,* Items 18431 and 36544, cited above.

The films of the invention can be constructed for exposure by a variety of sources capable of supplying digitally stored medical diagnostic images. In perhaps the simplest to visual method of exposure, the digitally stored image is displayed on a cathode ray tube (CRT). For this exposuring radiation source an element of the invention is physically positioned adjacent the outer surface of the CRT. Exposures are of relatively low intensity and exposure times are comparable to those of camera exposures.

Another common alternative technique is to expose elements of the invention with light emitting diode (LED). A single LED can used to expose the element pixel by pixel to reproduce the stored image. More typically the exposure element is constructed as a linear array of LED's. The image is then reproduced by exposing an element of the invention through a series of step and repeat line exposures.

In still another common technique a laser beam is directed to a film of the invention. The laser is used to expose the film in a pixel by pixel manner. The minimum pixel size is limited by the beam width of the laser. It is contemplated that useful medical diagnostic images will in all instances be formed with laser beam widths of less than 250 μm, preferably less than 200 μm, and optimally less than 150 μm.

LED and laser exposure apparatus in most instances and preferably are constructed to provide high intensity exposures. Exposure energy of at least $10^{-4}$ erg/cm$^2$, typically in the range from about $10^{-4}$ to 103 erg/cm$^2$, most commonly from $10^{-3}$ to $10^2$ ergs/cm$^2$ is contemplated. Exposure of the film element at any one location persists for only a short time interval. Typical maximum pixel exposure times are up to 100 microseconds, often less than 10 microseconds, and, with more powerful lasers, only 0.05 microsecond. Minimum pixel exposure times of down to 0.01 microsecond are contemplated.

As is well understood to those skilled in the art, pixel density can vary widely. In general image sharpness increases with increasing pixel density, but at the expense of increased exposure equipment complexity. In general, pixel densities used in conventional electronic printing methods are contemplated. These do not exceed $10^7$ pixels/cm$^2$ and are typically in the range of from $10^4$ to $10^6$ pixels/cm$^2$.

A discussion of exposure of silver halide photographic emulsions to reproduce digitally stored images is provided by Hioki U.S. Pat. No. 5,126,235, Budz et al U.S. Pat. No. 5,451,490, published European Patent Applications to Tsuji 0 592 882 and Goedeweeck 0 610 608 and 0 679 937, and Firth et al, "A Continuous-Tone Laser Color Printer", *Journal of Imaging Technology*, Vol. 14, No. 3, June 1988, the disclosures of which are here incorporated by reference. The Goedeweeck disclosures are particularly directed to reproducing digitally stored medical diagnostic images.

Rapid access processing following imagewise exposure can be undertaken in the same manner as that of conventional dual-coated medical diagnostic imaging elements. The rapid access processing of such elements is disclosed, for example, in Dickerson et al U.S. Pat. Nos. 4,803,150, 4,900,652, 4,994,355, 4,997,750, 5,108,881, 5,252,442, and 5,399,470, the disclosures of which are here incorporated by reference. A more general teaching of rapid access processing is provided by Barnes et al U.S. Pat. No. 3,545,971, the disclosure of which is here incorporated by reference. More specifically, the rapid access processing cycle and typical developer and fixer described above in connection with Kodak X-OMAT 480 RA™ is specifically contemplated for use in the practice of this invention, which is here incorporated by reference.

EXAMPLES

The invention can be better appreciated by reference to the following specific embodiments. Coating coverages placed in parenthesis are in units of mg/dm$^2$, except as otherwise stated. Silver halide coating coverages are reported in terms of the weight of silver.

Film A

This illustrates a comparative film useful for reproducing digitally stored medical diagnostic images in which radiation-sensitive silver halide is coated on only one surface of the support.

The general structure of Film A was as follows:

| |
|---|
| SURFACE OVERCOAT (SOC-1) |
| INTERLAYER (IL-1) |
| EMULSION LAYER (EL) |
| |
| TRANSPARENT BLUE TINTED FILM (S-tbt) |
| |
| PELLOID (PL) |
| INTERLAYER (IL-2) |
| SURFACE OVERCOAT (SOC-2) |

(A)

SOC-1

| | |
|---|---|
| Gelatin | (4.4) |
| Matte beads | (0.2) |
| Silicone lubricant | (0.14) |

IL-1

| | |
|---|---|
| Gelatin | (4.4) |
| Gloss control grains | (4.3) |

The gloss control grains were cubic $AgCl_{0.70}Br_{0.30}$ grains that had been chemically and spectrally sensitized similarly as the grains contained in the emulsion layer.

EL

| | |
|---|---|
| Gelatin | (24.7) |
| Grains | (28.7) |
| Antifoggant | (0.7) |
| Resorcinol | (0.2) |
| Sodium disulfocatechol | (0.2) |
| Quat salt | (0.1085) |

The grains were a 1:1 weight ratio (based on silver) of $AgCl_{0.70}Br_{0.30}$ in mean size ranges of 0.28 μm (fast) and 0.16 μm (slow). The grains were sulfur and gold chemically sensitized and optimally spectrally sensitized with anhydro-9-ethyl-3,3'-bis(3-sulfopropyl)-4,5,4',5'-dibenzothiacarbocyanine hydroxide, sodium salt. The quat salt was N,N'-[1,10-(3,8-dithiadecylene)]bis(1-methylpiperidinium) p-toluenesulfonate. The antifoggant was 4-hydroxy-6-methyl-2-methylmercapto-1,3,3A-tetraazaindene (3 g/Ag M).

S-tbt

The film support was a conventional blue tinted 7 mil (177.8 mm) transparent poly(ethylene terephthalate film support with conventional subbing layer units coated on its opposite major faces. Each subbing layer unit contained a layer of poly(acrylonitrile-co-vinylidene chloride) overcoated with a layer of Gelatin (1.1).

PL

| | |
|---|---|
| Gelatin | (26.9) |
| Absorbing Dye 1 | (0.96) |
| Absorbing Dye 2 | (1.74) |

Absorbing Dye 1 was bis[3-methyl-1-(p-sulfophenyl)-2-pyrazolin-5-one-(4)]pentamethineoxonol, and Absorbing Dye 2 was 1,4-benzene sulfonic acid, 2-[3-acetyl-4-{5-[3-acetyl-1-(2,5-disulfophenyl)-1,5-dihydro-5-oxo-4H-pyrazol-4-ylidene]-1,3-pentadienyl}-5-hydroxy-1H-pyrazol-1-yl] pentasodium salt.

IL-2

| | |
|---|---|
| Gelatin | (4.4) |

SOC-2

| | |
|---|---|
| Gelatin | (4.4) |
| Matte beads | (0.29) |
| Antistat | (1.5) |
| Silicone lubricant | (0.14) |

The Antistat was a mixture of a fluorocarbon surfactant, Zonyl FSN™, and lithium tetrafluoroborate.

Film A–S

This film was identical to Film A, except that the fast component grains were replaced with additional slow component grains. Overall silver coverages remained unchanged.

Film A–F

This film was identical to Film A, except that the slow component grains were replaced with additional fast component grains. Overall silver coverages remained unchanged.

Film B

The general structure of Film B was identical to Film A, except that the emulsion layer was split into two layers, with the one of the emulsion layers replacing the pelloid.

The general structure of Film A was as follows:

| |
|---|
| SURFACE OVERCOAT (SOC-1) |
| INTERLAYER (IL-1) |
| EMULSION LAYER (EL-s) |
| |
| TRANSPARENT BLUE TINTED FILM (S-tbt) |
| |
| EMULSION LAYER (EL-s) |
| INTERLAYER (IL-2) |
| SURFACE OVERCOAT (SOC-2) |

(B)

EL-s

The components of EL-s were identical to those of EL of Film A. The coating coverages of each EL-s layer were as follows:

| | |
|---|---|
| Gelatin | (12.4) |
| Grains | (12.4) |
| Antifoggants | (0.35) |
| Resorcinol | (0.1) |
| Sodium disulfocatechol | (0.1) |
| Quat salt | (0.108) |

Film B–I

This film was identical to Film B, except that the fast component grains were all coated in one EL-s layer while the slow component grains were all coated in the remaining EL-s layer. Overall silver coverages remained unchanged.

Film C

This film was identical to Film B, except that the transparent film support was clear, not blue tinted.

Film D

This film was identical to Film C, except that a processing solution decolorizable particulate dye (AD-1) for absorbing exposing radiation was coated in the back surface overcoat and interlayer.

The general structure of Film A was as follows:

| |
|---|
| SURFACE OVERCOAT (SOC-1) |
| INTERLAYER (IL-1) |
| EMULSION LAYER (EL-s) |
| |
| TRANSPARENT CLEAR FILM (S-c) |
| |
| EMULSION LAYER (EL-s) |
| INTERLAYER (IL-2 + AD-1) |
| SURFACE OVERCOAT (SOC-2 + AD-1) |

(D)

AD-1 was equally distributed between the back surface overcoat and interlayer. The overall coating coverage of AD-1 was 0.22 mg/dm$^2$. AD-1 was chosen, since it exhibits high levels of absorption in the 633 to 670 nm region in which helium-neon lasers and red-emitting LED's in current use emit. AD-1 is 4-{5-[1-(4-carboxyphenyl)-1,5-dihydro-3-methyl-5-oxo-4H-pyrazol-4-ylidene]-1,3-pentadienyl}benzoic acid. AD-1 increased the optical density of the film at 670 nm by 0.20 optical density units. AD-1 was selected as representative of dyes having a half peak absorption bandwidth over the spectral region of from 633 to 690 nm.

File E

Film E was identical to Film D, except that the coating coverage of AD-1 was doubled. AD-1 increased the optical density of the film at 670 nm by 0.43 optical density units.

Film F

Film F was identical to Film D, except that the coating coverage of AD-1 was increased four times. AD-1 increased the optical density of the film at 670 nm by 0.85 optical density units.

Exposure and Processing

The elements were exposed using a Luminsys-L-00™ helium-neon laser emitting at 670 nm with beam width (spot size) of 100 μm when the modulation transfer factors (MTF) of the exposed and processed film were measured to ascertain image sharpness. When the drying rates of the film samples were being studied, the film samples were each flash exposed to produce an overall density of 1.0 when fully processed.

Processing was conducted using a Kodak X-OMAT M6A-N™ processor, using the processing cycle, developer and fixer, previously described.

Drying Characteristics

To compare rates of drying (and hence to assess the maximum rate which a film can be passed through the drying section of a rapid access processor), as a film just exists from the rapid accessor processor, the processor was stopped and the film was removed. Roller marks on the film were noted, indicative of incomplete drying. Marks over all of the film indicate incomplete drying. Marks over less than all of the film indicate that the film has dried at some intermediate location within the drier section of the rapid access processor. Drying rates are reported in terms of the percentage of the drying section required to completely dry the film (% Drying).

A comparison of the drying characteristics of samples of Film A, a conventional type single emulsion layer film, and Film B, representative of the dual-coated format of the films of the invention, is provided in Table I.

TABLE I

| Film | Percent Drying |
|---|---|
| A | 50 |
| B | <30 |

From Table I it is apparent that going from a one emulsion layer format to a dual-coated emulsion layer format resulted in a 40 percent reduction in drying time. In other words, going to a dual-coated format would allow the drying time to be reduced from 20 to 12 seconds while still utilizing only 50 percent of the drying capacity of the processor.

Although Table I reports results only for Film B, the percent drying for all of the dual-coated films described above, B, B–I, C, D, E and F, were observed to be essentially similar.

Sharpness Characteristics

The image sharpness characteristics of the films were compared by measuring MTF. As is well understood, MTF declines with increased image frequency (cycles/mm). The single MTF value reported is the average (50%) value observed over the cycle range.

The results are summarized in Table II.

TABLE II

| Film | Format | Support | AD-1 | MTF |
|---|---|---|---|---|
| A | single-sided | blue tinted | no | 1.53 |
| B | dual-coated | blue tinted | no | 0.66 |
| C | dual-coated | clear | no | 0.44 |
| D | dual-coated | clear | yes | 0.83 |
| E | dual-coated | clear | yes | 1.22 |
| F | dual-coated | clear | yes | 1.36 |

The highest measured level of MTF was, as expected, obtained with the single-sided (one emulsion layer) format of Film A. When a dual-coated format was substituted, without other modifications, Film B, MTF was highly degraded. When Film B was further modified to substitute a colorless (clear) transparent film support for the blue-tinted film support, a further loss in MTF of −0.22 was observed.

When the absorbing dye AD-1 was located in the back SOC and IL the dual-coated films, Films D, E and F demonstrated that MTF was dramatically improved. It is apparent that, if Film F had been constructed using a blue tinted support rather than a clear support, its MTF would have been equal to that of single-side Film A. That is, substitution of the blue tinted support would have increased MTF by approximately 0.22. Thus, it is apparent that the films of the invention are capable of maintaining MTF levels of single-sided films while offering the capability of more rapid processing.

Flame Pattern Testing

During processing developer solution is circulated across the upper surface of horizontally oriented film sheets, emanating from jets mounted just outwardly of an adjacent edge of the film sheet. Non-uniform development, identified as bands of non-uniform density, emanating from the edge of the fully processed film, are commonly observed. These non-uniform densities are commonly referred to as "flame patterns". The intensity of flame patterns is judged on a rating scale of from zero (no observed flame pattern) to 10.

A comparison of flame patterns is shown in Table III.

TABLE III

| Film | Format | Emulsion(s) | Flame Pattern Rating |
|---|---|---|---|
| A | single-sided | Fast + Slow | 4 |
| A-S | single-sided | Slow | 6 |
| A-F | single-sided | Fast | 3 |
| B | dual-coated | Fast + Slow | 3 |
| B-I | dual-coated | Slow/Fast | 4 |
| F | dual-coated | Fast/Slow | 2 |

In comparing emulsions in a single-sided format, it is apparent that the slower emulsion is significantly more susceptible to flame pattern non-uniformities than the faster emulsion.

The invention offers the unexpected advantage that a blended emulsion in a dual-coated format exhibits less non-uniformity than the same emulsion blend in a single-sided format. The highest attainable levels of uniformity (lowest flame pattern rating) were realized when the faster and slower emulsions were coated on opposite sides of the support and the faster emulsion layer was located above the slower emulsion layer while the film was passing by the developer circulation jets within the rapid access processor.

Residual Dye Stain

The inclusion of dye AD-1 in Films D, E and F did not noticeably raise the minimum density of the film after processing. In all instances the minimum density of Films D, E and F were judged to be increased by substantially less than 0.1 after processing, indicating substantially complete decolorization of the dye during processing.

The invention has been described in detail with particular reference to preferred embodiments thereof, but it will be understood that variations and modifications can be effected within the spirit and scope of the invention.

What is claimed is:

1. A radiation-sensitive silver halide film for reproducing digitally stored medical diagnostic images through radiation exposure from one side by a cathode ray tube, photodiode or laser and processing, including development, fixing and drying, in 90 seconds or less comprised of a film support transparent to the exposing radiation to be recorded and having front and back major faces, a processing solution permeable front layer unit coated on the front major face of the support capable of absorbing up to 60 percent of the exposing radiation and containing (a) hydrophilic colloid, the amount of said hydrophilic colloid being limited to less than 30 mg/dm$^2$, and (b) radiation-sensitive silver halide grains, the amount of the silver halide grains being limited to less than 30 mg/dm$^2$ silver, and a processing solution permeable back layer unit coated on the back major face of the support containing (a) hydrophilic colloid, the amount of said hydrophilic colloid being limited to less than 40 mg/dm$^2$, (b) silver in the form of radiation-sensitive silver halide grains, the amount of the silver halide accounting for from 40 to 60 percent of the total radiation-sensitive silver halide present in the film, and (c) a dye capable of imparting to the film at the time of the radiation exposure an optical density of at least 0.40 in the wavelength region of the exposing radiation to be recorded and, after processing, an optical density of less than 0.1 in the visible spectrum, the radiation-sensitive silver halide grains in the front and back layer units having differing mean equivalent circular diameters and imaging speeds.

* * * * *